United States Patent [19]

Urbinati et al.

[11] 4,231,344

[45] Nov. 4, 1980

[54] AIR INDUCTION SYSTEMS FOR DIESEL ENGINES

[75] Inventors: Mario Urbinati; Luigi Conti, both of Turin, Italy

[73] Assignee: Centro Ricerche Fiat S.p.A., Turin, Italy

[21] Appl. No.: 2,641

[22] Filed: Jan. 11, 1979

[30] Foreign Application Priority Data

Jan. 20, 1978 [IT] Italy ..... 67105 A/78

[51] Int. Cl.[3] ..... F02M 61/14; F02F 7/00; F02B 77/02

[52] U.S. Cl. ..... 123/518; 123/572; 123/195 C; 123/198E

[58] Field of Search ..... 123/136, 198 E, 195 C, 123/119 B

[56] References Cited

U.S. PATENT DOCUMENTS

| | | | |
|---|---|---|---|
| 3,796,280 | 3/1974 | Thien | 123/198 E |
| 3,908,617 | 9/1975 | Partridge | 123/119 B |
| 3,924,597 | 12/1975 | Hatz | 123/198 E |
| 4,117,823 | 10/1978 | Funabashi | 123/195 C |

FOREIGN PATENT DOCUMENTS

| | | | |
|---|---|---|---|
| 1576405 | 4/1970 | Fed. Rep. of Germany | 123/119 B |

*Primary Examiner*—Charles J. Myhre
*Assistant Examiner*—Carl Stuart Miller
*Attorney, Agent, or Firm*—Sughrue, Rothwell, Mion, Zinn & Macpeak

[57] ABSTRACT

An air induction system which reduces the fuel odor and noise of a diesel engine includes two acoustically insulating baffle elements which cover a fuel pump, fuel pipes and fuel injectors and cause the air inducted by the engine to pass through an air filter interposed between the baffle elements, thereby inducting the fumes from the fuel system along respective pipes which extend across the top of the engine into respective cylinder air induction ducts.

5 Claims, 2 Drawing Figures

AIR INDUCTION SYSTEMS FOR DIESEL ENGINES

The present invention relates to air induction systems for diesel engines, that is, internal combustion engines having compression-ignition.

More particularly, the invention is concerned with air induction systems for diesel engines comprising at least one cylinder having a respective fuel injector and air induction duct, and a fuel pump located adjacent the engine and connected to the or each fuel injector by a respective fuel pipe.

The object of the present invention is to provide an air induction system for a diesel engine of the aforesaid type, which is more compact than air induction systems in current use, and which will reduce the odour from fuel fumes emanating from the fuel system by causing the fumes to be inducted by the engine.

According to the present invention there is provided an air induction system for an internal combustion engine having compression ignition and comprising at least one cylinder having a respective fuel injector and air induction duct, and a fuel pump located adjacent the engine and connected to the or each fuel injector by a respective fuel pipe, in which the air induction system comprises a baffle fixed to the engine to cover the fuel pump, the fuel injectors, and their associated fuel pipes so as to cause the air inducted by the engine to flow over the said components, an air filter located in a space between the engine and the baffle so that the air inducted by the engine passes through the filter, and at least one pipe for conducting the filtered air into the induction duct of a respective cylinder of the engine, the or each pipe extending across the top of the engine.

Preferably, the baffle elements are made from an acoustically absorbent material in order to contribute to the acoustic insulation of the engine.

Figure 1:
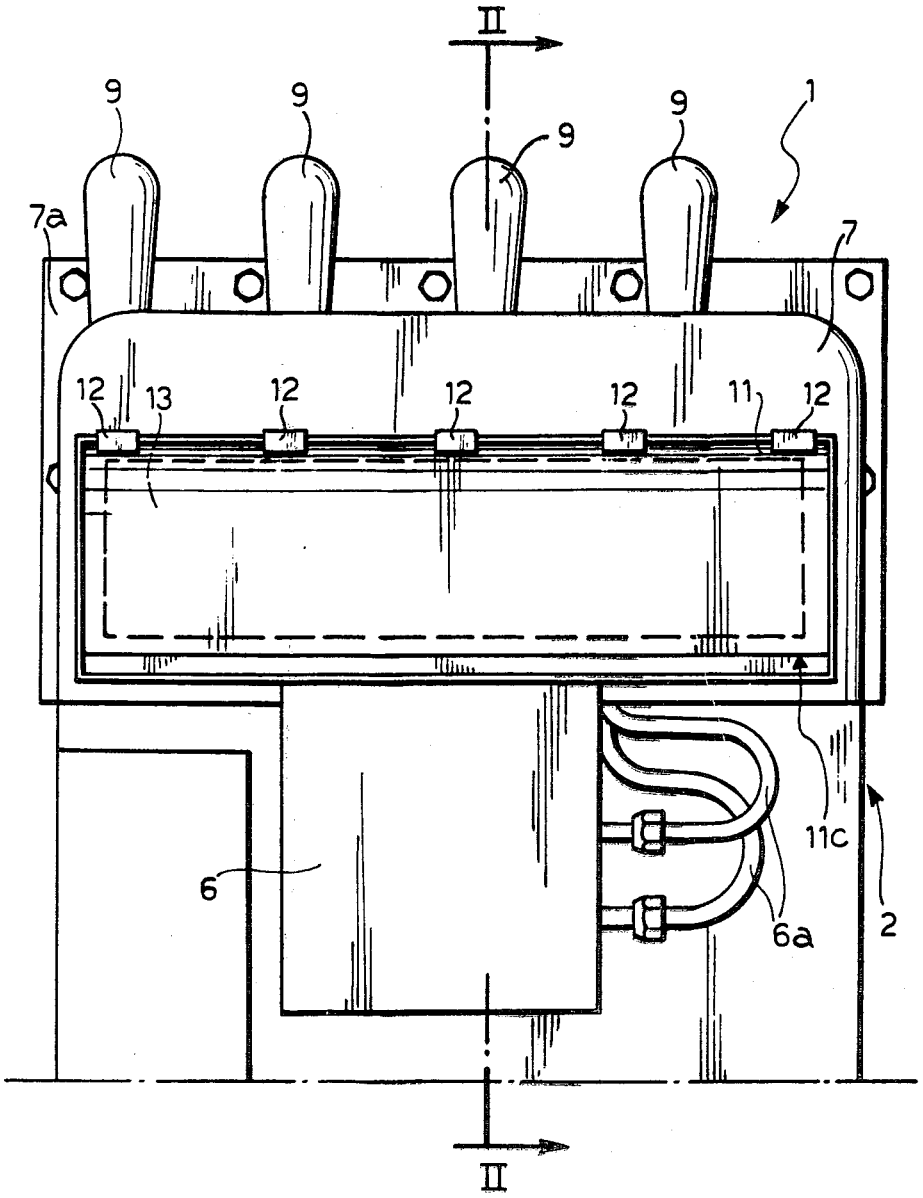
Figure 2:
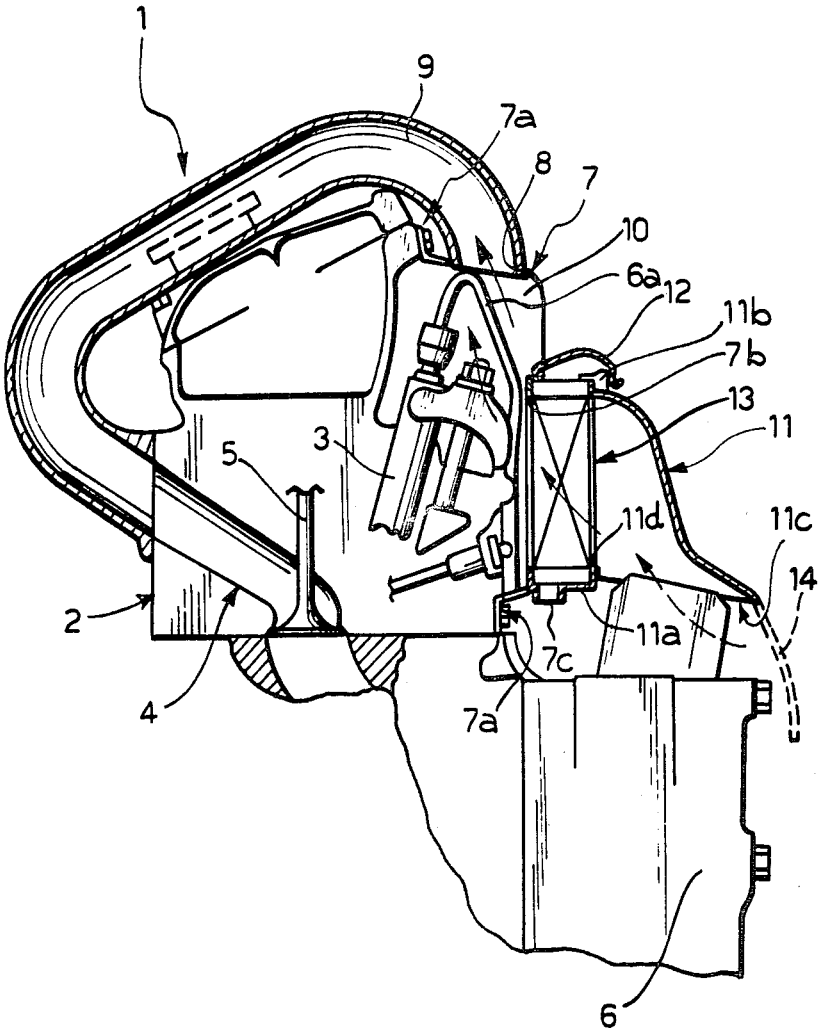

One embodiment of the invention will now be more particularly described, by way of example, with reference to the accompanying drawings, in which:

FIG. 1 is a side view of part of a diesel engine incorporating an air induction system according to the invention; and FIG. 2 is a sectional view taken along the line II—II of FIG. 1.

Referring now to the drawings, there is shown an air induction system, generally indicated 1 and including a baffle 7, 11, of a diesel engine 2, that is, an internal combustion engine having compression ignition. Each cylinder (not shown) of the engine 2 has, respectively, a fuel injector 3, an air induction duct 4 and a valve 5 which controls the induction of air into the cylinder compression chamber (not shown). A fuel pump 6, located adjacent the engine 2, is connected to each fuel injector by an associated fuel pipe 6*a*.

A first, trough-shaped, baffle element 7 has a rectangular vertical base wall of acoustically absorbent material. The element 7 has a peripheral fixing flange 7*a* through which fixing screws pass to secure the element 7 to the engine 2. The baffle element 7 covers the fuel injectors 3 and their associated fuel pipes 6*a*. The upper part (as shown) of the first element 7 is provided with a number of holes 8, corresponding to the number of cylinders in the engine 2, within each of which is fitted a respective pipe 9. Each pipe 9 connects the air induction duct 4 of a respective cylinder with an internal space 10 defined within the first element 7. An elongate, rectangular aperture 7*b* in the first element 7 permits air inducted by the engine 2 to enter the internal space 10.

A second baffle element, comprising a hood 11 made from an acoustically absorbent material, is located over the fuel pump 5 and is attached to the first element 7 at its lower end by hooks 11*a* which engage cooperating lugs 7*c* on the lower edge of the first element 7 and, at its upper end, by a number of tongues 11*b* which are engaged by cooperating resilient clip elements 12, carried by the first element 7. The hood 11 has an elongate rectangular air inlet 11*c* at its lower end adjacent the hooks 11*a*. An elongate rectangular aperture 11*d*, adjacent the inlet 11*c* permits air to enter an air filter 13 which is interposed between facing edges of the first and second elements 7, 11. The aperture 7*b* connects the air filter 13 with the chamber 10 of the first element 7.

The system 1 operates as follows: the air inducted by the engine 2 enters the second baffle element 11 through the lower air inlet 11*c*, passes through the aperture 11*d*, and through the air filter 13 into the chamber 10. From the chamber 10 the air is conducted by the pipes 9 and the respective induction ducts 4 to the combustion chamber of each cylinder.

The air inducted by the engine flows over the fuel pump 6, the fuel pipes 6*a* and the fuel injectors 3 causing the fuel fumes emanating from these components to be inducted into the combustion chambers of the engine cylinders with the air and, consequently, reduces the odour in the vicinity of the engine.

The baffle elements 7, 11, being made from a soundproofing material contribute to the acoustic insulation of the engine, particularly, the chamber 10 of the first element 7, which is located downstream of the air filter 13 and, as a result, reduces the noise due to the passage of air through the filter 13.

The arrangement of the air filter 13 and the pipes 9 feeding air to the cylinders of the engine 2 also has the advantage, in relation to known systems, of being more compact. Each of the pipes 9 is adjacent and above the engine 2. The preferred method of releasable attachment of the second element 11 to the first element 7, as described above, has the advantage of being easy to assemble and disassemble.

In an alternative embodiment the air induction system has a third baffle element comprising a screen 14, shown diagrammatically in broken outline in FIG. 2, which extends downwardly from the outer edge of the air inlet 11*c* of the second element 11 to cover at least partially the fuel pump 6 and thereby improve the acoustic insulation of the engine.

What is claimed is:

1. In an internal combustion engine having compression ignition and comprising:

at least one cylinder, at least one fuel injector, said at least one cylinder having a respective said fuel injector, at least one air induction duct defined by a respective said at least one cylinder, a fuel pump located adjacent said engine, and at least one fuel pipe connecting said fuel pump with a respective said fuel injector, an air induction system comprising:

baffle means fixed to said engine to cover said fuel pump, said fuel injectors and said associated fuel pipes, whereby the air inducted by said engine is caused to flow over said components, said baffle means defining an internal space, an air filter located in said internal space upstream of said fuel injectors and said fuel pipes, whereby the air inducted by said engine passes through said filter prior to passing over said fuel injectors and said fuel pipes, and at least one pipe for conducting filtered air from said space into the air induction duct of a respective said cylinder, said at least one pipe being located above said engine.

2. An air induction system as defined in claim 1, wherein said baffle means are made from acoustically absorbent material.

3. An air induction system as defined in claim 1, wherein said baffle means comprise:

a first element which has a trough-shape and includes at least one upper hole receiving a respective said pipe connected to a respective said induction duct, and a lower aperture through which the air inducted by said engine enters said internal space defined by said baffle means, said first element covering said fuel injectors and said fuel pipes; and a second element which forms a hood located over said fuel pump, said second element being connected externally to said first element and said air filter being interposed between said first and second elements adjacent said lower aperture of said first element so that the air inducted by said engine is deflected by said second element through said air filter into said first element.

4. An air induction system as defined in claim 3, wherein said second element has a lower part attached to said first element by hooks and an upper part attached to said first element by a plurality of resilient elements, said air filter being interposed between facing surfaces of said first and second elements.

5. An air induction system as defined in claim 3, wherein said baffle further includes a third element in the form of a curtain dependant from said lower edge of said second element.

* * * * *